US005487590A

United States Patent [19]

Haynes

[11] Patent Number: 5,487,590

[45] Date of Patent: Jan. 30, 1996

[54] CHAIR TO PROMULGATE KINESTHETIC THERAPY: APPARATUS AND METHOD

[76] Inventor: Robin Haynes, 1730 Industrial Dr., Auburn, Calif. 95603

[21] Appl. No.: 268,785

[22] Filed: Jun. 30, 1994

[51] Int. Cl.[6] ..... A47C 1/02

[52] U.S. Cl. ..... 297/344.14; 297/195.11; 297/408; 297/338; 297/411.36; 601/24; 482/134; 482/142

[58] Field of Search ..... 297/195.11, 338, 297/344.14, 411.36, 423.12; 601/24; 606/242, 243, 244; 482/142, 134

[56] References Cited

U.S. PATENT DOCUMENTS

| | | | |
|---|---|---|---|
| D. 265,612 | 8/1982 | Gusrud et al. | D6/38 |
| 3,759,511 | 9/1973 | Zinkin et al. | 272/58 |
| 3,861,382 | 1/1975 | Simjian | 128/58 |
| 4,662,361 | 5/1987 | Patterson | 128/25 R |
| 4,699,423 | 10/1987 | Fitzig et al. | 297/245 |
| 4,798,395 | 1/1989 | Shaffer et al. | 280/240 |
| 4,858,919 | 8/1989 | Jones | 272/134 |
| 4,943,117 | 7/1990 | Brown | 297/392 |
| 5,020,795 | 6/1991 | Airy et al. | 272/129 |
| 5,040,522 | 8/1991 | Daniels | 128/25 R |
| 5,110,121 | 5/1992 | Foster | 482/137 |
| 5,158,074 | 10/1992 | Grellas | 128/25 R |
| 5,178,593 | 1/1993 | Roberts | 482/62 |
| 5,186,519 | 2/1993 | Larson | 297/423 |
| 5,295,728 | 3/1994 | Schaevitz | 297/423.12 |

OTHER PUBLICATIONS

Golden Ratio Oakworks product brochure 1994 p. 10.

Flyer included in Golden Ratio Oakworks product brochure (two pages) 1994.

Custom Craftworks product brochure 1994–1995 p. 6.

Stronglite product catalog 1993–1994 last page.

Oakworks advertisement in *Massage Therapy Journal*, vol. 33, No. 2 Spring 1994 p. 1.

*Primary Examiner*—Peter R. Brown
*Assistant Examiner*—Anthony D. Barfield
*Attorney, Agent, or Firm*—Bernhard Kreten

[57] ABSTRACT

A chair (10) to promulgate kinesthetic therapy including a seat frame (50), a chest rest frame (100), an arm rest frame (250) and a base (20). The seat frame (50) and the chest rest frame (100) are independently attached to the base (20) and extend upwardly and inwardly from the base (20) where they support a seat (80) and chest rest (152) respectively. Both the seat (80) and chest rest (152) are adjustable along the same axis A via frames (50) and (100) respectively. Axis A makes an oblique angle α with the plane of the base (20). The arm rest frame (250) is attached to the base (20) immediately in front of and parallel to the chest rest frame (100). The arm rest frame (250) includes an arm rest (280) which is horizontally supported and elevationally adjustable above the base (20). A head support (170) is spaced from the chest rest (152) via a pair of spaced parallel cantilevered arms (186), (188).

16 Claims, 6 Drawing Sheets

CHAIR TO PROMULGATE KINESTHETIC THERAPY: APPARATUS AND METHOD

FIELD OF THE INVENTION

This invention relates generally to a chair and, in particular, to a chair to promulgate kinesthetic therapy.

BACKGROUND OF THE INVENTION

A variety of chairs have been specifically designed for seated workers in an office and industrial environment as well as the home environment. For example, a number of chairs have been designed for computer users and assembly line workers. Theories have been developed to support each design and the major objective of each design has been to provide an ergonomic workplace chair.

Moreover, a number of chairs have been designed to promulgate kinesthetic therapy. Many of these chairs are portable and lack the necessary support as well as other features simply not possible in a portable unit. The stationary chairs which have been designed are often bulky and lack the proper adjustment angles of a seat, a head rest and an arm rest with respect to a chest rest. Furthermore, there has been a lack of easily operated independent adjustments for the seat, head rest, arm rest and chest rest with respect to one another.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | U.S. Pat. No. | ISSUE DATE |
|---|---|---|
| Zinkin, et al. | 3,759,511 | September 18, 1973 |
| Simjian | 3,861,382 | January 21, 1975 |
| Gusrud, et al. | Des. 265,612 | August 3, 1982 |
| Fitzig, et al. | 4,699,423 | October 13, 1987 |
| Shaffer, et al. | 4,798,395 | January 17, 1989 |
| Brown | 4,943,117 | July 24, 1990 |
| Roberts | 5,178,593 | January 12, 1993 |
| Larson | 5,186,519 | February 16, 1993 |

OTHER PRIOR ART (Including Author, Title, Date, Pertinent Pages, Etc.)

| DOCUMENT NUMBER | PUBLICATION | DATE | PAGE NUMBER |
|---|---|---|---|
| 1 | Golden Ratio Oakworks product brochure | 1994 | 10 |
| 2 | Flyer included in Golden Ratio Oakworks product brochure (two pages) | 1994 | entire flyer |
| 3 | Custom Craftworks product brochure | 1994–95 | 6 |
| 4 | Oakworks product brochure | undated | 5 |
| 5 | Oakworks product brochure | undated | 6 |
| 6 | Living Earth Crafts product brochure | undated | 11 |
| 7 | Living Earth Crafts product brochure | undated | 12 |
| 8 | Flyer included in Blue Ridge Tables, Inc. product brochure | undated | entire flyer |
| 9 | Stronglite product catalog | 1993–94 | last page |
| 10 | Oakworks advertisement in Massage Therapy Journal, Vol. 33, No. 2 | Spring 1994 | 1 |

U.S. Pat. No. 5,186,519 to Larson teaches the use of an adjustable chair comprised of a front seat assembly, a rear seat assembly and a base assembly supporting the front and rear seat assemblies independent of one another. The front seat assembly has a front seat and the rear seat assembly has a rear seat both pivotably mounted for rotation about a horizontal axis. The two rotation axes are separated from one another a sufficient distance that a person may sit on the front seat and position his or her back against the rear seat. Each seat is pivotably mounted by the respective seat assembly such that the rotation for each seat is located at a fulcrum point from which the seat is pivotably supported.

U.S. Pat. No. 4,943,117 to Brown teaches the use of a body weight distribution support chair. The chair includes a superstructure with a seat portion mounted thereto and spaced from a head/chest portion. The head/chest portion features a split portion to enable the user to see what he or she is working upon. Mounted to the head/chest portion is a pair of diverging arm supports. The superstructure also includes a pair of spaced opposed ankle supports. The weight of the body of the user is concentrated between the ankles and knees by permitting the chair user to position his or her body somewhat forwardly while providing the ability to utilize the hands freely.

Th other prior art listed above, but not specifically discussed, further catalogs the prior art of which the applicant is aware.

SUMMARY OF THE INVENTION

The instant invention is distinguished over the known prior art in a multiplicity of ways. One of the starkest differentiations that the instant invention enjoys over the known prior art involves the fact that the instant invention is a chair to promulgate kinesthetic therapy which provides means to independently adjust the elevation of a seat and a chest rest along the same axis. In this way, a practitioner is provided with the means to set the chest rest and the associated head support according to his or her optimum working height. Once the chest rest is set, the practitioner independently adjusts the seat along the same longitudinal axis as the chest rest. In this manner, the chest of the patient is aligned with the chest rest at a position which optimizes the comfort of the placement of the patient's chest thereon. In addition, an adjustable arm rest is provided which adjusts the arms of the patient in a parallel fashion with respect to the shoulders of a seated patient that is resting his or her chest against the chest rest.

More specifically, the chair includes a base independently supporting a seat frame and a chest rest frame. Both frames extend upwardly and inwardly from the base and support a seat and a chest rest above the base, respectively. The seat and the chest rest are adjustable along the same longitudinal axis. In addition, an arm rest frame is supported immediately adjacent to and parallel with the chest rest frame. The arm rest frame adjustably supports an arm rest above the base.

Operatively coupled to and spaced from the chest rest is a head support. The head support is provided with means to rotate and/or extend away from or toward the chest rest.

A hydraulic/electrical system provides the motive means to independently adjust the position of the seat and the arm rest. Alternatively, the seat frame and the arm rest frame may be independently elevatable by providing each frame with a pair of telescoping members, one having spring-loaded detents and the other having apertures configured to receive the detents therein.

OBJECTS OF THE INVENTION

A primary object of the present invention is to provide a new and useful chair to promulgate kinesthetic therapy.

A further object of the present invention is to provide a chair as characterized above which includes a base independently supporting a seat frame and a chest rest frame wherein both frames extend upwardly and inwardly from the base thus forming oblique angles with the base.

Another further object is to support a seat and chest rest above the base using the seat frame and chest rest frame respectively.

Another further object is to provide the means to independently adjust an elevation of both the seat and chest rest along the same longitudinal axis.

Another further object is to provide an independently adjustable arm rest frame extending from the base and supporting an arm rest above the base.

Another further object is to provide an adjustable head support spaced from and operatively coupled to the chest rest.

Another further object is to provide automatic adjustments to independently adjust the seat and arm rest.

Another further object is to provide a kinesthetic therapy chair which is adjustable to accommodate different physical dimensions of a patient and a therapist.

Viewed from a first vantage point, it is an object of the present invention to provide a chair to promulgate kinesthetic therapy comprising in combination a base, a horizontally supported planar member extending from the base, means for adjusting the elevation of the horizontally supported planar member, a chest rest extending from the base, means for adjusting a position of the chest rest, a head support, the head support operatively coupled to and spaced from the chest rest.

Viewed from a second vantage point, it is an object of the present invention to provide a chair to promulgate kinesthetic therapy comprising in combination a base, a seat frame supporting a seat, a chest rest frame supporting a chest rest, the base supporting the seat frame and the chest rest frame, and the seat frame and the chest rest frame facing each other canted upwardly and inwardly from the base wherein the seat and the chest rest are at an elevation above the base.

Viewed from a third vantage point it is an object of the present invention to provide a method for promulgating kinesthetic therapy, the steps comprising providing a base, providing a chest rest on the base, orienting height of the chest rest above the base, providing a seat on the base, seating a patient on the seat, and orienting an elevation of the seat with respect to the chest rest.

These and other objects will be made manifest when considering the following detailed specification when taken in conjunction with the appended drawing figures.

DESCRIPTION OF PREFERRED EMBODIMENTS

Figure 1:
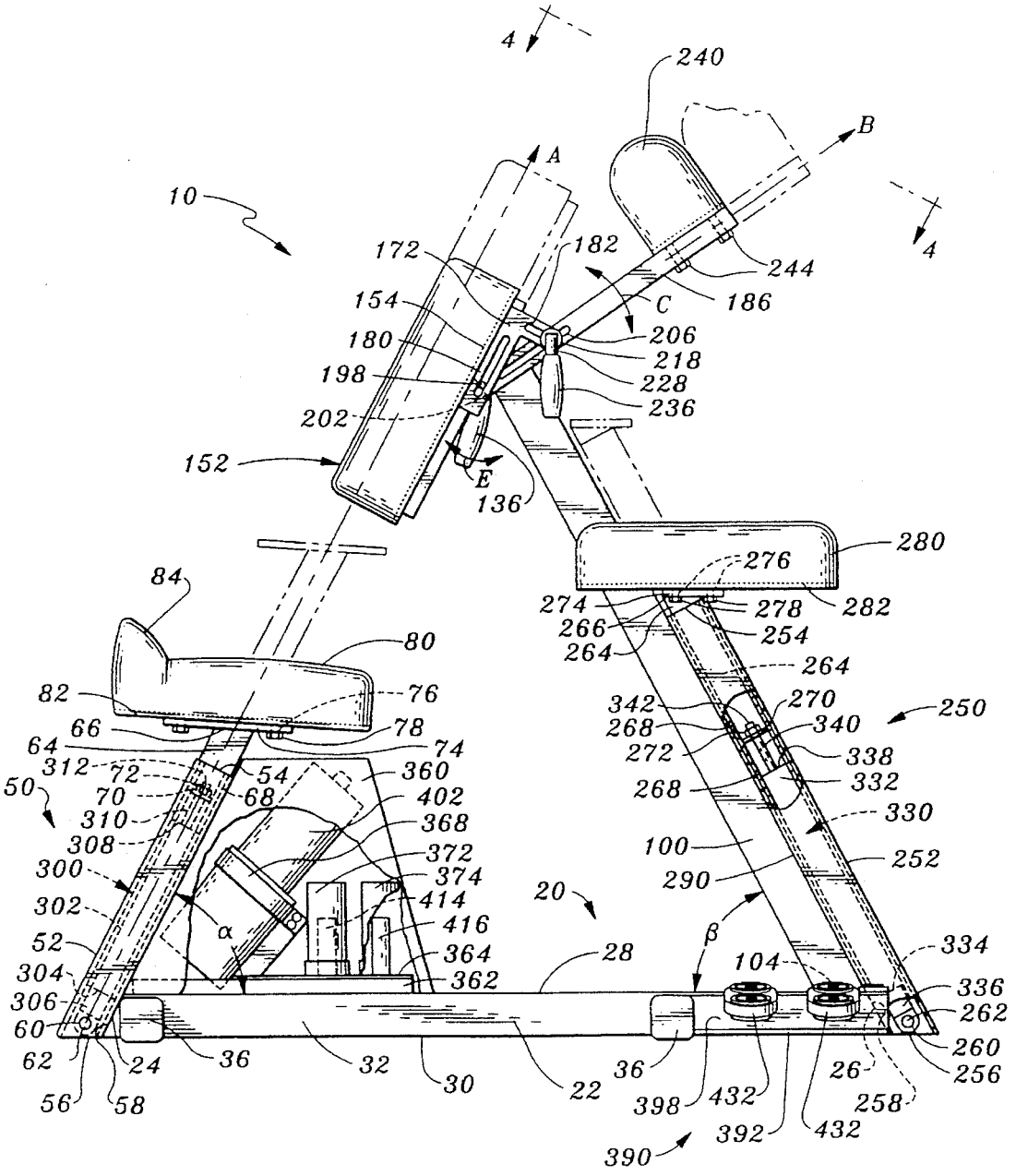
FIG. 1 is a side elevational view of a chair to promulgate kinesthetic therapy with a housing and a front inner and outer sleeve member partially fragmented, and showing, in phantom, the extension of the seat, chest rest, head support and arm rest.

Considering the drawings, wherein like reference numerals denote like parts throughout the various drawing figures, reference numeral 10 is directed to a chair for promulgating kinesthetic therapy.

Figure 2:
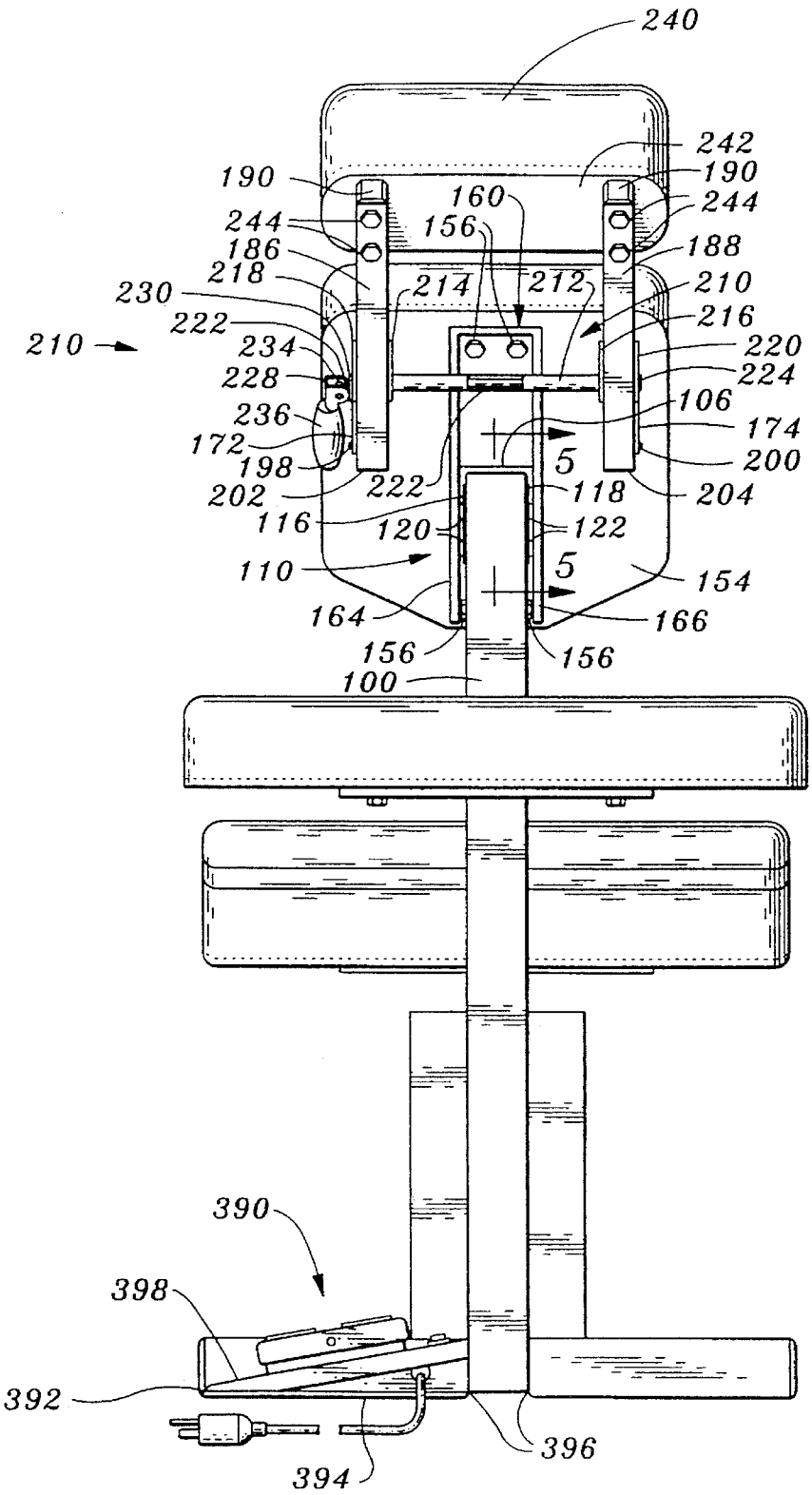
FIG. 2 is a front elevational view of the chair according to the present invention.

In essence, and referring to FIGS. 1 and 2, the chair 10 includes a base 20 having a main member 22 and a plurality of feet 36 extending laterally therefrom, thus providing lateral stability to the chair 10. A seat frame 50 is disposed on a back extremity 24 of the base 20 and extends therefrom in an upwardly and inwardly inclined manner. A seat 80 is attached to a top of the seat frame 50. The seat frame 50 includes a rear inner sleeve member 64 that nests within a rear outer sleeve member 52. When provided with a motive force the rear inner sleeve member 64 telescopically extends or retracts within the rear outer sleeve member 52 thereby adjusting the seat 80 along axis A.

A chest rest frame 100 is disposed on the base 20 proximate to a front extremity 26 of the base 20. The chest rest frame 100 extends from the base 20 in an upwardly and inwardly inclined manner terminating at an upper end 106 (FIG. 5) to a slidable bracket assembly 110. The slidable bracket assembly 110 supports a chest rest 152 and allows the chest rest 152 to be elevated or lowered along the axis A. A head support 240 is spaced from the chest rest 152 via a pair of parallel cantilevered arms 186, 188 operatively coupled to a back 154 of the chest rest 152.

Immediately in front of the chest rest frame 100 is an arm rest frame 250 that runs parallel to the chest rest frame 100 and is operatively coupled thereto and to the front extremity 26 of the base 20. The arm rest frame 250 includes a front inner sleeve member 264 that is telescopically extendable or retractable within a front outer sleeve member 252 when provided with a motive force. An arm rest 280 is attached to a top of the front inner sleeve member 264.

The motive force for independently extending or retracting the seat 80 and the arm rest 280 is provided by a hydraulic/electrical system 400 (FIG. 8) including control means 430 and hydraulic lifts 300 and 330. Each lift 300, 330 is interposed between and operatively coupled to each pair of inner and outer sleeve members 52, 252 and 64, 264 respectively. The chair structure delineated above basically describes an isosceles triangle having an opening on one side which the patient closes when seated and oriented in a preferred position.

The padding of the seat 80, chest rest 152, head support 240 and arm rest 280 should be adequate to allow pressure to be distributed but not so soft that the bone structure of each respective area being supported bottoms out. The upholstery of the seat 80 may be, for example, leather, vinyl or fabric.

Figure 3:
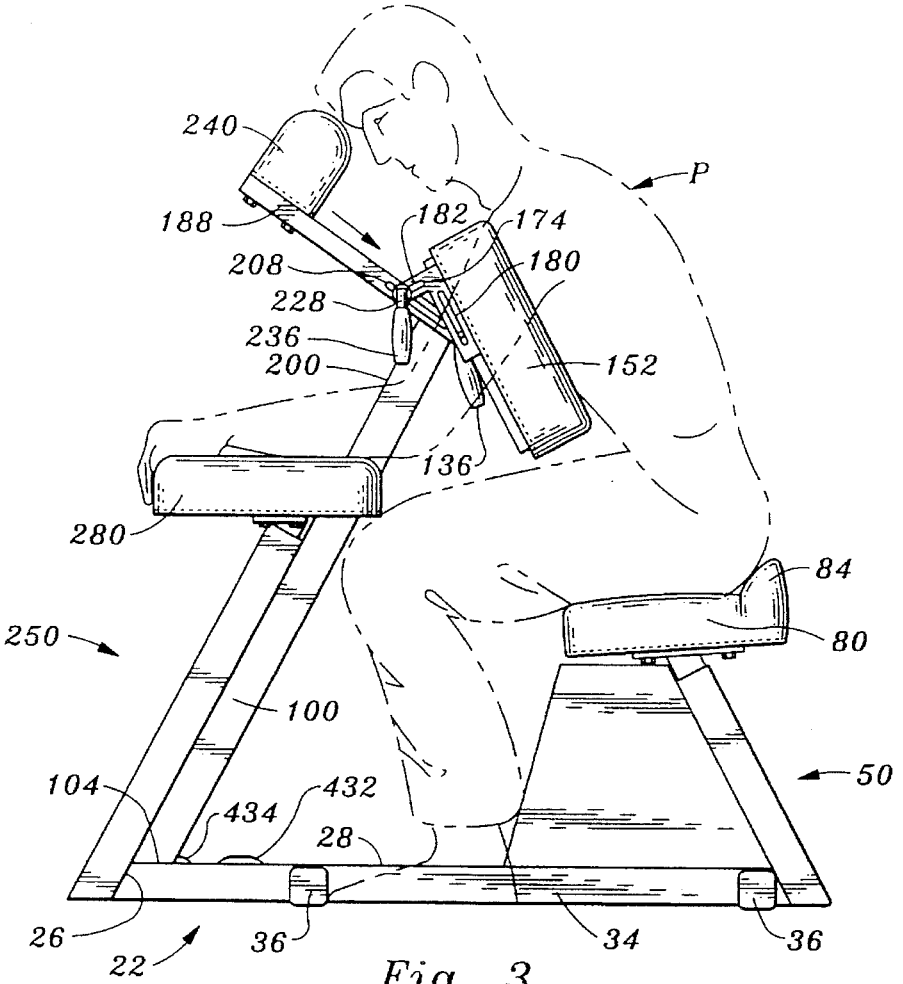
FIG. 3 is a side elevational view of the chair according to the present invention in which a patient is shown orientated thereon.
Figure 4:
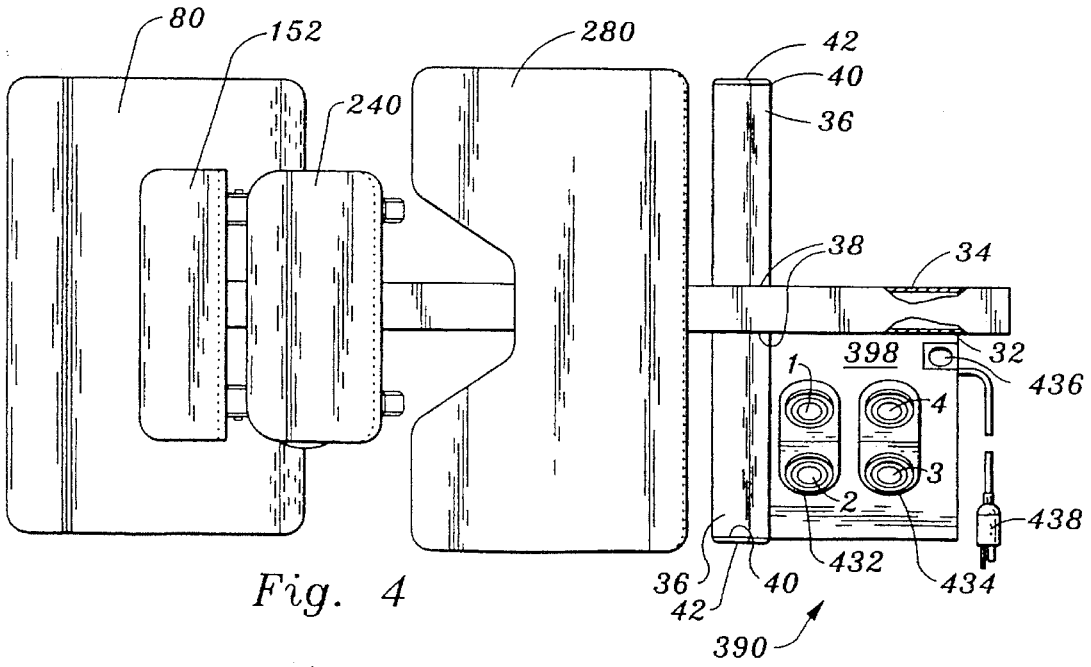
FIG. 4 is an elevational view of the present invention along lines 4—4 of FIG. 1.

More specifically, and referring to FIGS. 1 and 3, the base 20 of the chair 10 includes an elongated horizontal main member 22 preferably formed from rigid hollow square stock. The main member 22 includes a rear extremity 24, a front extremity 26, a top 28, a bottom 30 and two parallel sides 32, 34. Each of the two sides 32, 34 is provided with a pair of feet 36 spaced apart from one another and laterally extending away from the main member 22 thereby providing lateral stability to the chair 10. The opposed feet 36, which are spaced from each other by the main member 22, are substantially co-linear. Referring to FIG. 4, each foot 36 is preferably formed from rigid square stock and attached to the main member 22 by welding one end 38 of each of the feet 36 to opposite sides 32, 34 of the main member 22. The opposite end 40 of each foot 36 is capped, preferably with a hard plastic covering 42 that conceals any sharp edges.

Referring to FIG. 1, the rear outer sleeve member 52 is attached to the rear extremity 24 of the main member 22 and extends therefrom in an upwardly and inwardly inclined manner, thus forming an oblique angle α, preferably of 73°, between the main member 22 and the rear outer sleeve member 52. Preferably, the rear outer sleeve member 52 is formed from square stock and is attached by welding an adjacent side 58 of a lower end 56 to the rear extremity 24 of the main member 22.

The rear inner sleeve member 64 is configured to be nestable within the rear outer sleeve member 52 and has a top end 66 terminating to a substantially horizontal plate 74 that supports a seat 80 which is provided with a back lip 84. The horizontal plate 74 is provided with apertures 76 which allow fasteners 78 to be passed through and then fastened to a reinforced backing 82 of the seat 80. The plate 74 provides an area supporting the seat 80. Preferably, the reinforced backing 82 is wood and the fasteners 78 are wood screws.

The hydraulic lift 300 is interposed between the rear outer and inner sleeve members 52, 64 and fits within the members 52, 64. The hydraulic lift 300 includes a fluid cylinder 302 having a bottom end 304 and a top end 308. The top end 308 includes a cylinder rod 310 which extends from the cylinder 302 or retracts within the cylinder 302 depending on the direction of fluid flow provided to a port 20 (FIG. 8) of the cylinder 302 by a motive means described infra. The top 312 of the rod 310 is threaded and passes through an apertured crossbar 70 and threads into a nut 72. The apertured crossbar 70 and nut 72 are preferably welded proximate to the bottom 68 of the rear inner sleeve member 64. The bottom end 304 of the cylinder 302 is provided with a bored extension 306 that is in alignment with a through aperture 60 that has been provided through the lower end 56 of the rear outer sleeve member 52. A pin 62 is frictionally fitted within the bored extension 306 and the through aperture 60 thereby securing the cylinder 302 to the lower end 56 of the rear outer sleeve member 52.

The chest rest frame 100, preferably of square stock, is attached to the main member 22. This attachment is preferably by welding a bottom end 104 of the chest rest frame 100 to the top 28 of the main member 22 proximate to the front extremity 26. The chest rest frame 100 extends from the main member 22 in an upwardly and inwardly inclined manner, thus forming a second oblique angle β, preferably of 73°, between the main member 22 and the chest rest frame 100.

Figure 5:
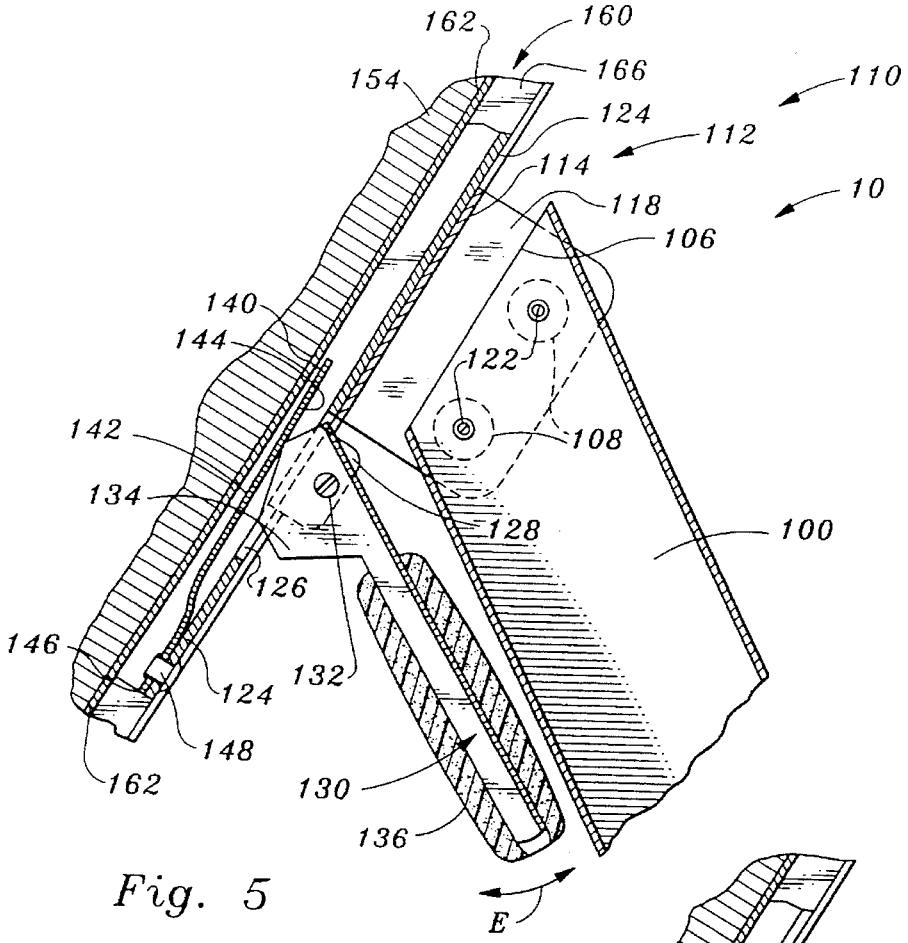
FIG. 5 is a sectional view of the present invention along lines 5—5 of FIG. 2 showing a slidable bracket means in an unlocked position.

Referring to FIGS. 2 and 5, a bracket 112 having a substantially flat top 114 and two downwardly extending sides 116, 118 straddles the top end 106 of the chest rest frame 100. The bracket 112 is provided with a pair of apertures 120, 122 on each of the two downwardly extending sides 116, 118. The pair of apertures 120 on one side 116 are aligned with the pair of apertures 122 on the other side 118 via a set of passageways 108 that extend through the chest rest frame 100 proximate to its top end 106.

The flat top 114 of the bracket 112 supports a mounting plate 124 that is integrally formed with or welded to the flat top 114 of the bracket 112. The mounting plate 124 is slidably coupled to a reinforced back 154 of the chest rest 152 via a track 160. The track 160 includes a flat planar surface 162 and two downwardly opposing L-shaped edges 164, 166 that form the guide rails in which the mounting plate 124 slides. The flat planar surface 162 of the track 160 is secured to the reinforced backing 154 of the chest rest 152 by passing fasteners 156 through apertures provided in the flat planar surface 162 and then fastening them into the reinforced backing 154 of the chest rest 152. Preferably, the reinforced backing 154 is wood and the fasteners 156 are wood screws.

Figure 6:
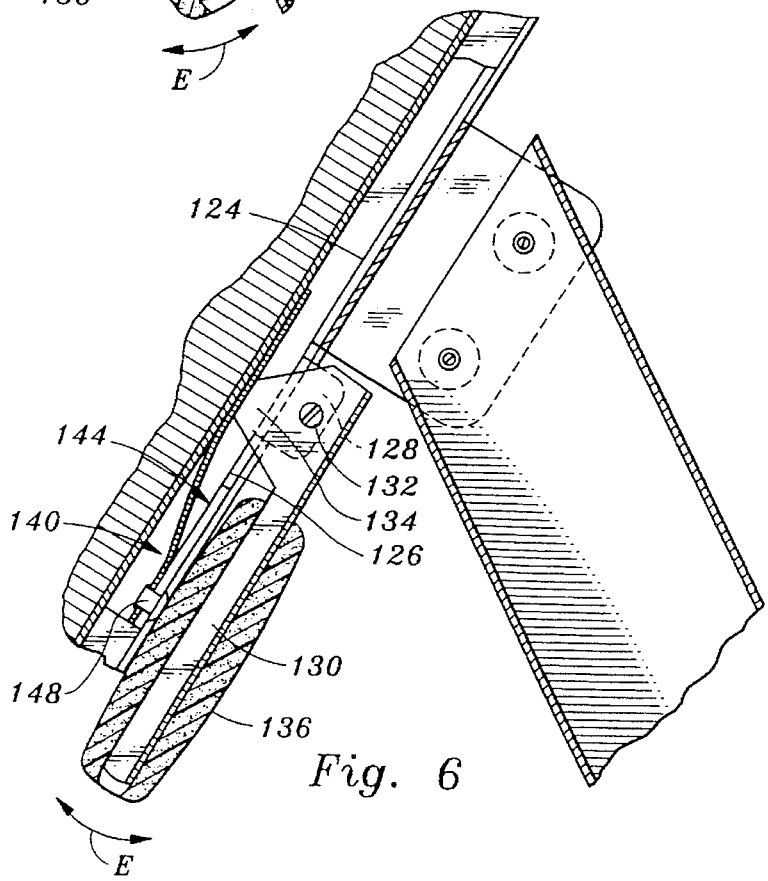
FIG. 6 is a view similar to FIG. 5 showing the slidable bracket means in a locked position.

Referring to FIG. 5, the mounting plate 124 is provided with a downwardly extending tab 128 and a window 126 adjacent thereto. A wedge 140, preferably formed of metal, is riveted via a rivet 148 to the mounting plate 124 at a location below the window 126. A P-shaped lever 130 having a non-slip handle 136 is pivotably mounted to the tab 128 via pin 132. A protruding face 134 of the lever 130 passes through the window 126 and comes in contact with an underside 144 of the metal wedge 140. FIG. 5 shows the lever 130 having been rotated away from the chest rest 152 about arrow E thereby allowing the lever 130 to be in a released position such that the wedge 140 is out of contact with the flat planar surface 162 of the track 160. In this position, the chest rest 152 can be translated along the same axis A along which the adjustable seat frame 50 extends. When the lever 130 is rotated toward the chest rest 152 about arrow E the chest rest 152 is locked in a stationary position as shown in FIG. 6.

Referring to FIGS. 1 and 3, a pair of brackets 172 and 174 are spaced apart in parallel planes and fastened to the back 154 of the chest rest 152. Each bracket 172, 174 includes a first slotted leg 180 running parallel to the back 154 of the chest rest 152 and a second slotted leg 182 running perpendicular to the back 154 of the chest rest 152. The brackets 172, 174 adjustably support the first and second outer spaced parallel cantilevered arms 186, 188.

Referring to FIGS. 1 and 2, the first and second spaced parallel cantilevered arms 186, 188 are preferably formed from square stock. The radiused head support 240 is attached proximate a closed end 190 of each of the cantilevered arms 186, 188. This attachment is preferably by way of wood screws 244 passing through each arm 186, 188 and then threading into the reinforced back 242, preferably formed of wood. Each arm 186, 188 is provided with a pin 198, 200 adjacent the end 202, 204 of each arm 186, 188 which is distal from the radiused head support 240. An elongated opening 206, 208 (FIGS. 1 and 3) extends along each arm 186, 188 and is located slightly above each pin 198, 200. The arms 186, 188 are interposed between the two perpendicular brackets 172, 174 and are coupled in a manner which allows the arms 186, 188 to be adjustable along axis B and rotatable about arrow C. A compression fitting assembly 210 is used to couple the elongated opening 206, 208 of each cantilevered arm 186, 188 to the respective second slotted leg 182 in each bracket 172 and 174.

The compression fitting assembly 210 locks the cantilevered arms 186, 188, positioning the head support 240 in a desired stationary position. The compression fitting assembly 210 includes a compression sleeve 212 having a washer 214, 216 disposed on each end of the compression sleeve 212. The compression sleeve 212 is interposed between the two cantilevered arms 186, 188 such that both washers 214 and 216 contact an inner surface of each cantilevered arm 186, 188 and are in alignment with the elongated opening 206, 208 of each cantilevered arm 186, 188. An outer washer 218, 220 is disposed on the outer surface of each perpendicular bracket 172, 174 and in alignment with each second slot 182.

A rod 222 runs from the outside of one outer washer 220 to the outside of the other outer washer 218 while passing through the outer washers 220, 218, the second slots 182, the elongated openings 206, 208, the inner washers 214, 216 and the compression sleeve 212. One end of the rod 222 is provided with an oversized head 224 which abuts the outside of one outer washer 220. The other end of the rod 222 is provided with a lever arm 228, having a protruding face 230, a non-slip grip 236 and a pivoting pin 234. The lever arm 228, when rotated about pin 234 toward arm 186, causes the protruding face 230 to place a force on the outer washer 218 in a direction of the inner washer 214 thereby locking the cantilevered arm 186 between the outer washer 218 and the rigidly spaced inner washer 214. Simultaneously, the rotation of the lever arm 228 about pin 234 causes the oversized head 224 of the rod 222 to place a force on the outer washer 220 in a direction of the rigidly spaced inner washer 216, thereby locking the cantilevered arm 188 between the outer washer 220 and the rigidly spaced inner washer 216.

The pins 198, 200 of the arms 186, 188 ride in the first slots 180. The pins 198, 200 in the slots 180 constrain the ends 202, 204 from swinging away from the back 154 of the chest rest 152 while allowing the head support 240 to be adjusted along the B axis and about arrow C.

Referring to FIG. 1, the front outer sleeve member 252 is attached to the front extremity 26 of the main member 22 and extends therefrom in an upwardly and inwardly inclined manner. Preferably the front outer sleeve member 252 is formed from square stock and attached by welding an adjacent side 258 of a lower end 256 to the front extremity 26. The front outer sleeve member 252 preferably runs parallel with the chest rest frame 100 and, for additional support, is tac welded along the seam 290 of the abutment between the front outer sleeve member 252 and the frame 100.

The front inner sleeve member 264 is configured to be nestable within the front outer sleeve member 252 and has an uppermost end 266 terminating to a substantially horizontal bracket 274 which provides an expanded reinforced area that supports an arm rest 280. The horizontal bracket 274 is provided with apertures 276 which allow fasteners 278 to be passed through and then fastened to a reinforced bottom 282 of the arm rest 280. Preferably, the reinforced bottom 282 is wood and the fasteners 278 are wood screws.

A second hydraulic lift 330, substantially identical to the first hydraulic lift 300 is interposed between and fits within the front inner and outer sleeve members 264, 252. The hydraulic lift 330 includes a fluid cylinder 332 having a bottom end 334 and a top end 338. The top end 338 includes a cylinder rod 340 which extends from the cylinder 332 or retracts within the cylinder 332 depending on the fluid level provided to the cylinder 332 by the motive means described infra. The top 342 of the rod 340 is threaded and passes through an apertured crossbar 270 and threads into a nut 272. The apertured crossbar 270 and nut 272 are preferably welded proximate to the lowermost end 268 of the front inner sleeve member 264. The bottom of the cylinder 334 is provided with a bored extension 336 which is in alignment with an aperture 260 that has been provided on each side of the lower end 256 of the front outer sleeve member 252. A pin 262 is frictionally fitted within the bored extension 336 and the apertures 260 thereby securing the cylinder 332 to the lower end 256 of the front outer sleeve member 252.

Figure 8:
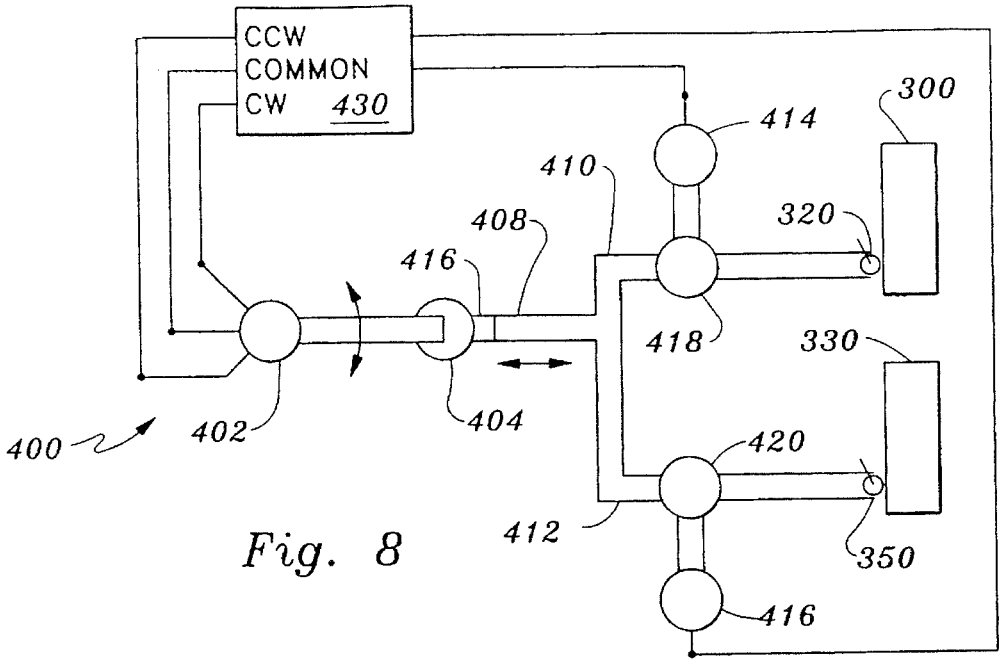
FIG. 8 is a block diagram of the hydraulic/electrical system of the chair according to the present invention.

Referring to FIGS. 1 and 8, the hydraulic/electrical system 400 provides the motive means for independently adjusting the elevation of the seat 80 and the arm rest 280. The hydraulic/electrical system 400 is comprised of a reversible electric motor 402, a rotary hydraulic pump 404, a pipe line 408, solenoids 414, 416, solenoid operated valves 418, 420, and the two hydraulic lifts 300, 330, described supra. In addition, the system 400 includes control means 430 which is provided to actuate the motor 402 and the solenoids 414, 416 which independently open and close valves 418, 420 respectively.

A foundation 362 is disposed on the base 20. The foundation 362 includes an upper surface 364 that supports capacitors 372, 374 and solenoids 414, 416. In addition, motor 402 is supported on the upper surface 364 via bracket 368.

Referring to FIG. 8, the reversible electric motor 402 is operatively coupled to the rotary hydraulic pump 404. The hydraulic pump 404 includes a port 406 which serves as an inlet or outlet of fluid depending on the direction in which the motor 402 is activated.

The pipe line 408 is operatively coupled to and extends from the port 406 of the hydraulic pump 404 and then bifurcates into two separate pipes 410, 412. Each of these pipes 410, 412 continue on to and operatively couple with cylinder ports 320, 350 respectively. Valves 418, 420 are respectively coupled in line with pipes 410 and 412.

Figure 9:
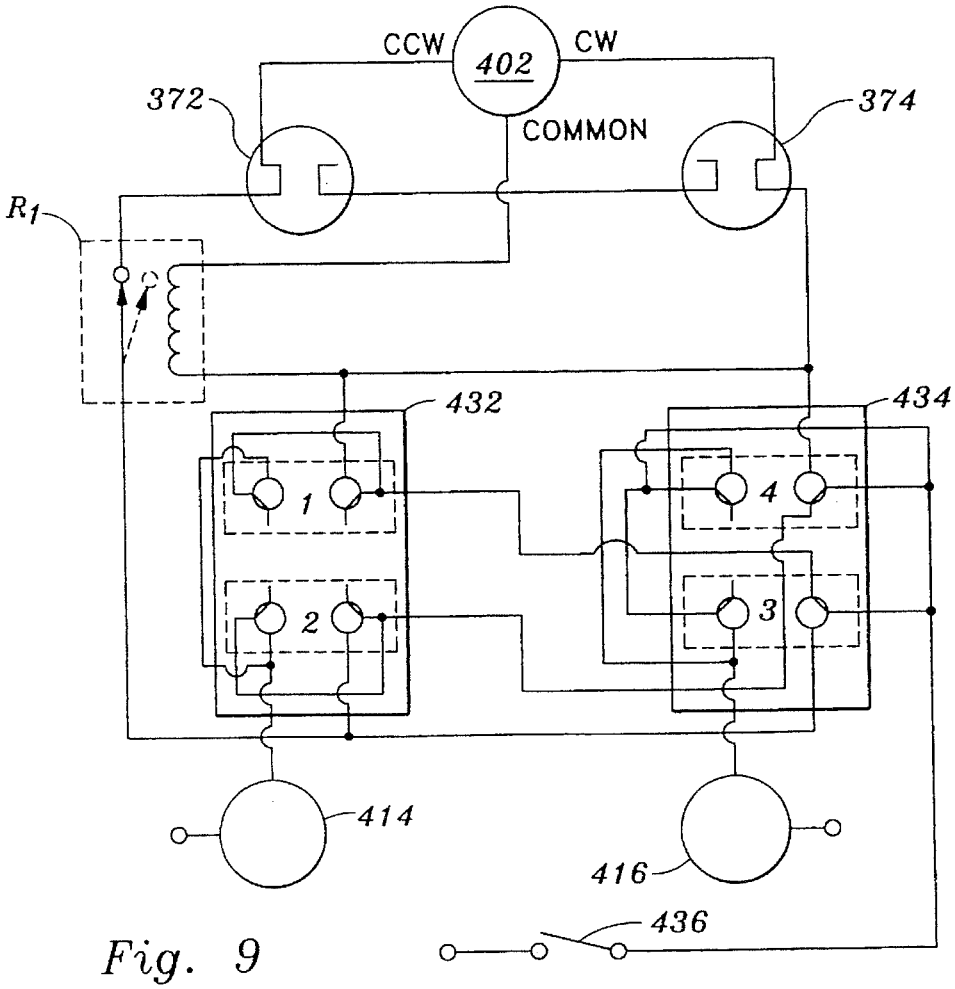
FIG. 9 is a schematic of the electrical system of the chair according to the present invention.

The control means 430 physically shown in FIG. 4 and shown schematically shown in FIG. 9, preferably includes two "momentary" rocker switch units 432, 434 coupled to a top surface 398 of an inclined plane 390. The inclined plane 390 is coupled to the side 32 of the base 20 proximate to front extremity 26 and tapers away from the base 20 to a thin edge 392. Each switch 432, 434 includes two double pole double throw switches which have been delineated in FIG. 9 by dashed blocks labeled 1 through 4 which correspond to the numbers 1 through 4 on the switches in FIG. 4. One supplier of switches 432, 434 is Electric Switches Incorporated, of Los Angeles, Calif., which sells these switches under catalog number L-4-5. In addition, an on/off switch 436 is disposed on the surface 398 of the inclined plane 392. Power is provided through the switch 436 to the motor 402, the solenoids 414, 416 and both rocker switch units 432, 434 via a standard plug 438 (FIG. 4) and wall outlet. The switches 432, 434 are configured to be easily toggled by the foot of a user between three positions including a neutral and two opposite momentary positions.

Referring to Table 1 and FIGS. 8 and 9, the nine switching options will now be delineated. Initially, note that the switches 432 and 434 in FIG. 9 are shown in their neutral or normal position and when activated in pairs or blocks are switched to the opposite pole position and then are returned to their neutral or normal position when deactivated. Capacitors 372 and 374 are shunted across the motor 402 to smooth out the transient response of turning the motor 402 on and off or switching it from one direction to another, thus alleviating any jerking motion when adjusting the elevation of the seat 80 and arm rest 280.

The result of each switching option in table 1 is revealed by starting at switch 436 in FIG. 9 and following the connections of the switches described for each individual case.

Case A in table 1 corresponds to the neutral or normal position shown in FIG. 9. Case A shows that both switches 432, 434 and solenoids 414, 416 are deactivated thereby causing valves 418 and 420 to be in the closed position. This causes the seat 80 and the arm rest 280 to remain in a stationary position.

Case B in table 1 shows that switch 432 is in its neutral position and block 4 of switch 434 is activated thereby making a connection to drive the motor 402 in a clockwise direction and activating solenoid 416 to open valve 420 thus raising the arm rest 280.

Case C in table 1 shows that switch 432 is in its neutral position and block 3 of switch 434 is activated thereby making a connection to drive the motor 402 in a counter-clockwise direction and activating solenoid 416 to open valve 420 thus lowering the arm rest 280.

Case D in table 1 shows that block 1 of switch 432 is activated and switch 434 is in the neutral position thereby making a connection, via block 1, to drive the motor 402 in a clockwise direction and activating solenoid 414 to open valve 418 thus raising the seat 80.

Case E in table 1 shows that block 1 of switch 432 is activated along with block 4 of switch 434 thereby making a connection to drive the motor 402 in a clockwise direction and activating both solenoids 414 and 416 which in turn open valves 418 and 420 thus raising both the seat 80 and the arm rest 280.

Case F in table 1 shows that block 1 of switch 432 is activated along with block 3 of switch 434 thereby attempting to drive the motor 402 in a clockwise and counter-clockwise direction. A safety system prevents a situation where one actuator is asked to travel up while one actuator is asked to travel down. This is accomplished by deactivating the electrical connection to one of the two motor directions. Preferably this is accomplished by using a normally closed connected relay switch $R_1$. This type of relay $R_1$ is connected in series between the counter-clockwise lead of the motor 402 and the power supply. The coil of the relay switch $R_1$ is activated any time that the clockwise lead to the motor 402 is activated thereby opening the connection between the counter-clockwise lead of the motor 402 and the power supply. This results in a dominant clockwise activation of the motor 402. Therefore, the result of case F is the activation of both solenoids 414 and 416 which in turn open valves 418 and 420 thereby raising both the seat 80 and the arm rest 280.

Case G in table 1 shows block two of switch 432 activated and switch 434 in the neutral position thereby activating the motor 402 counter-clockwise and energizing only solenoid 414 thereby opening only valve 418 thereby lowering the seat 80.

Case H in table 1 shows block 2 of switch 432 activated along with block 4 of switch 434 thereby activating the motor 402 in a clockwise direction and energizing both solenoid valves 414 and 416 which in turn open valves 418 and 420 respectively. This again incorporates the safety feature and raises both the seat 80 and arm rest 280.

Case I in table 1 shows that block 2 of switch 432 and block 3 of 434 are activated thereby activating the motor 402 in a clockwise direction and energizing both valve 414 and valve 416 thereby opening valves 418 and 420. This causes both the seat 80 and the arm rest 280 to lower.

Figure 7:
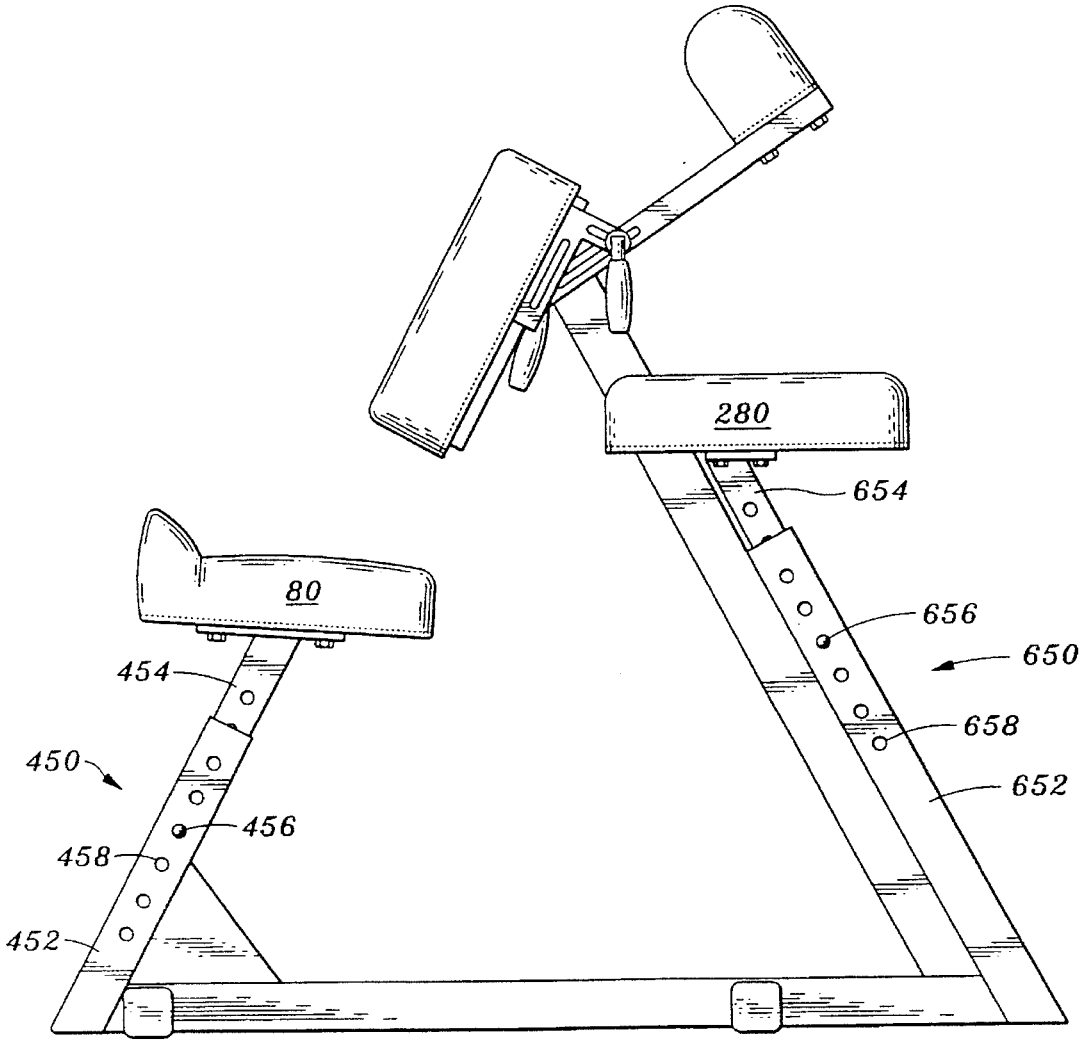
FIG. 7 is an alternative embodiment of that which is shown in FIG. 1.

FIG. 7 is an alternative embodiment of the means for independently adjusting and maintaining the elevation of the seat frame 50 and the arm rest frame 250. Thus, as seen in FIG. 7, the frames 50, 250 have been renumbered 450 and 650 respectively. The hydraulic/electrical system 400 has been completely removed and replaced with a spring-loaded detent and aperture system. The detents 456, 656 are provided on each inner sleeve member 454 and 654 respectively. The detents 456, 656 are respectively received in apertures 458 and 658 provided in the corresponding outer sleeve members 452 and 652, thus maintaining the elevation of the seat frame 450 and the arm rest frame 650. Simply pushing on the detents 456, 656 will cause them to disengage from their respective apertures 458, 658 thereby allowing an adjustable elevation of the frame members 450, 650.

In use and in operation, and referring to the drawings, a practitioner operates the chair 10 in the following manner. Initially the practitioner grasps the non-slip grip 136 of lever 130 and rotates it along arrow E away from the back 154 of the chest rest 152. This releases the chest rest 152 and allows the practitioner to adjust the elevation of the chest rest 152, along axis A, according to his or her optimum working height. In other words, the height that provides less stress and strain on the practitioner when working. Then, the associated head support 240 is initially adjusted using lever 228. Once the chest rest 152 and head support 240 are locked into position, the patient is seated on seat 80 and the practitioner actuates the rocker switch 432 in one of two directions to either raise or lower the seat 80 along axis A. The practitioner continues the actuation of rocker switch 432 until the chest of the patient aligns with the chest rest 152 at a position which optimizes the comfort of the placement of the patient's chest thereon. After this adjustment the practitioner may readjust the head support 240 according to the patient's desire. Once the patient is in a comfortable position, rocker switch 434 is actuated to automatically adjust the arm rest 280 in a parallel fashion with respect to the shoulders of the patient. The practitioner has now adjusted the chair for the comfort of both the practitioner and the patient thereby creating a stressless and strainless environment in which the practitioner promulgates kinesthetic therapy on the patient.

Moreover, having thus described the invention, it should be apparent that numerous structural modifications and adaptations may be resorted to without departing from the scope and fair meaning of the instant invention as set forth hereinabove and as described hereinbelow by the claims.

TABLE 1

HYDRAULIC SWITCHES AND MOTOR OPERATIONS

| CASE | SWITCH 432 BLOCK 1 SEAT UP | SWITCH 432 NEUTRAL | SWITCH 432 BLOCK 2 SEAT DOWN | SWITCH 434 BLOCK 4 ARM UP | SWITCH 434 NEUTRAL | SWITCH 434 BLOCK 3 ARM DOWN |
|---|---|---|---|---|---|---|
| A | | X | | | X | |
| B | | X | | X | | |
| C | | X | | | | X |
| D | X | | | | X | |

TABLE 1-continued

| HYDRAULIC SWITCHES AND MOTOR OPERATIONS | | | | | | | |
|---|---|---|---|---|---|---|---|
| E | X | | | X | | | |
| F | X | | | | | | X |
| G | | | X | | | X | |
| H | | | X | X | | | |
| I | | | X | | | | X |
| CASE | MOTOR 402 CLOCK-WISE | MOTOR 402 COUNTER CLOCK-WISE | MOTOR 402 OFF | VALVE 418 OPEN | VALVE 418 CLOSED | VALVE 420 OPEN | VALVE 420 CLOSED |
| A | | | X | | X | | X |
| B | X | | | | X | X | |
| C | | X | | | X | X | |
| D | X | | | X | | | X |
| E | X | | | X | | X | |
| F | X | | | X | | X | |
| G | | X | | X | | | X |
| H | X | | | X | | X | |
| I | X | | | X | | X | |

I claim

1. A massage chair, comprising, in combination:

a base having a longitudinal extent and longitudinal extremities;

a seat support at one said longitudinal extremity;

a seat fixed horizontally and telescopically supported on said seat support;

chest, arm and face support at another said extremity;

said supports in the same vertical plane and having acute angles facing upwardly and inwardly towards each other but spaced apart at upper extremities thereof defining an open space between an upper surface of said seat and a lower surface of a chest pad;

an arm pad fixed horizontally and telescopically supported on said chest, arm and face support;

said chest pad located on said chest, arm and face support and having means to adjust said chest pad along an axis coincident with said seat support telescoping adjustment; and a face pad connected to said chest, arm and face support and having axial adjustment means and arcuate adjustment means.

2. The chair of claim 1 wherein said means for adjusting said elevation of said seat includes an electrically actuated hydraulic lift.

3. The chair of claim 2 wherein said electrically actuated hydraulic lift adjusts and maintains said elevation of said seat along a longitudinal axis which forms an oblique angle with said base.

4. The chair of claim 3 wherein said base includes a main member having a plurality of feet laterally extending therefrom.

5. The chair of claim 4 wherein said means for adjusting a position of said chest rest includes a slidable bracket assembly which allows said chest rest to be adjusted and maintained at a position along said longitudinal axis.

6. The chair of claim 5 including means for adjusting an elevation of said horizontally supported arm pad carried on said chest, arm and face support.

7. The chair of claim 5 wherein said means to restrict said chest pad includes a slidable bracket assembly having a fixed bracket extending parallel to said longitudinal axis, said chest pad including means to slide along said fixed bracket and along said longitudinal axis and means to releasably secure said chest pad in a stationary position along said fixed bracket.

8. The chair of claim 6 wherein said means for adjusting said elevation of said arm pad includes an electrically actuated hydraulic lift which adjusts and maintains said elevation of said arm pad.

9. The chair of claim 1 including means for extending, retracting and rotating said face support with respect to said chest pad and connected to said chest support.

10. A massage chair, comprising, in combination;

a base having a longitudinal extent and longitudinal extremities;

a seat support at one said longitudinal extremity;

a seat fixed horizontally and telescopically supported on said seat support;

chest, arm and face supports at another said extremity;

said supports in the same vertical plane and having acute angles facing upwardly and inwardly towards each other but spaced apart at upper extremities thereof defining an open space between an upper surface of said seat and a lower surface of a chest pad;

an arm pad fixed horizontally and telescopically supported on said chest, arm and face support;

said chest pad located on said chest, arm and face support and having means to adjust height of said chest pad and angle of said chest pad; and a face pad connected to said chest, arm and face support and having axial adjustment means and arcuate adjustment means.

11. The chair of claim 10 wherein said face support is supported by and spaced from said chest pad support.

12. The chair of claim 11 including means for adjusting a position of said face support with respect to said chest pad and connected to said chest support.

13. The chair of claim 12 further including an arm pad frame extending from said base and supporting an arm pad above said base.

14. The chair of claim 13 wherein said arm pad frame includes means for adjusting and maintaining an elevation of said arm pad carried on said chest, arm and face support.

15. The chair of claim 14 wherein said seat support includes means to adjust and maintain said seat at a position along a longitudinal axis which forms an oblique angle with said base, and wherein said chest pad frame supporting said chest pad includes means to restrict said chest pad to a position along said longitudinal axis and means to adjust a distance of said chest pad away from said seat and connected to said chest, arm and face support.

16. A massage chair, comprising, in combination:

a base having a longitudinal extent and longitudinal extremities;

a seat support at one said longitudinal extremity;

a seat fixed horizontally and telescopically supported on said seat support;

chest, arm and face supports at another said extremity;

said supports in the same vertical plane and having acute angles facing upwardly and inwardly towards each other but spaced apart at upper extremities thereof defining an open space between an upper surface of said seat and a lower surface of a chest pad;

an arm pad fixed horizontally and telescopically supported on said chest, arm and face support;

said chest pad located on said chest, arm and face support and having means for adjusting said chest pad along an axis approximately parallel to the spine of a client when resting in and supported by said massage chair; and a face pad connected to said chest, arm and face support and having axial adjustment means and arcuate adjustment means.

* * * * *